United States Patent [19]

Thettu

[11] 3,965,332

[45] June 22, 1976

[54] SELECTIVE FUSING APPARATUS

[75] Inventor: Raghulinga R. Thettu, Webster, N.Y.

[73] Assignee: Xerox Corporation, Stamford, Conn.

[22] Filed: Mar. 10, 1975

[21] Appl. No.: 556,858

[52] U.S. Cl. ..... 219/216; 219/388; 219/469; 250/317; 432/60; 432/228

[51] Int. Cl.[2] ..... H05B 1/00; G03G 15/20

[58] Field of Search.... 219/216, 348, 388, 469–471; 432/228, 227, 59, 60; 355/3 R; 250/317–319

[56] References Cited

UNITED STATES PATENTS

| | | | |
|---|---|---|---|
| 3,371,915 | 3/1968 | Kawamura et al. | 219/216 X |
| 3,452,181 | 6/1969 | Stryjewski | 219/388 |
| 3,465,122 | 9/1969 | Kolless | 219/216 |
| 3,475,589 | 10/1969 | Bartusek et al. | 219/216 |
| 3,679,302 | 7/1972 | Ludwig | 355/3 X |
| 3,811,821 | 5/1974 | Ariyama et al. | 432/60 X |
| 3,832,065 | 8/1974 | Sullivan | 355/3 R |
| 3,861,860 | 1/1975 | Thettu et al. | 437/59 |

*Primary Examiner*—C. L. Albritton

[57] ABSTRACT

Apparatus of the type which fuses toner images onto support material by heat and pressure. A heated fuser roll includes a cylindrical member made of quartz which transmits radiant energy from a lamp source located on the interior of the cylindrical member. The cylindrical member is covered with a layer made of elastomeric material which also transmits radiant energy. A first reflector member is positioned adjacent the lamp source for focusing the radiant energy along a heat transfer zone segment of the elastomeric layer. Positioned adjacent to the heat transfer zone is a second reflector member to reflect the energy back to the surface of the layer. Tack and detack corotrons tack sheets bearing powder images to be fused to the surface of the elastomeric layer to selectively heat the powder images. A pressure roll forms a nip with the layer at the exit of the heat transfer zone to apply heat and pressure thereat. A blower controls the exit temperature of the exit of the nip to effect fusing of the images without objectionable background.

4 Claims, 3 Drawing Figures

SELECTIVE FUSING APPARATUS

This invention relates to an improved fusing apparatus used in an electrostatic reproduction system to produce high quality copies free of background particles.

It has been recognized that one of the preferred ways for fusing a powder image to a support material is to bring the powder image into direct contact with a hot surface, such as a heated roller. The roller surface may be dry, i.e. no application of a liquid release agent to the surface of that roller as described for example, in U.S. Pat. Nos. 3,498,596, 3,539,161, and 3,666,247. Alternatively, the fuser roll surface may be wetted with a release agent such as silicone oil as described in U.S. Pat. Nos. 3,268,351 and 3,256,002.

A problem associated with the pressure heated fusing apparatus is the relatively long time for warm up prior to reaching operating fusing temperature and the depositing of background particles onto copy sheets due to overheating thereof. It is known to employ radiation absorbing materials for the fuser roll construction to effect faster warm up time as described for example, in U.S. Pat. No. 3,669,706. The instant invention enables instant start fusing capability without any loss of fusing quality such as toner offset in background areas.

It is therefore the principle object of the present invention to improve pressure heated fusing apparatus.

It is a further object of the present invention to enable rapid starting pressure heated fusing apparatus.

It is a further object of the present invention to prevent toner offset from the surface of a heated fuser roll onto copy sheets.

It is a further object of the present invention to improve copy quality of copy sheets fused by selective fusing.

These as well as other objects of the invention and further features thereof will be better understood upon reference to the following detailed description of the invention to be read in connection with the drawings wherein.

Figure 1:
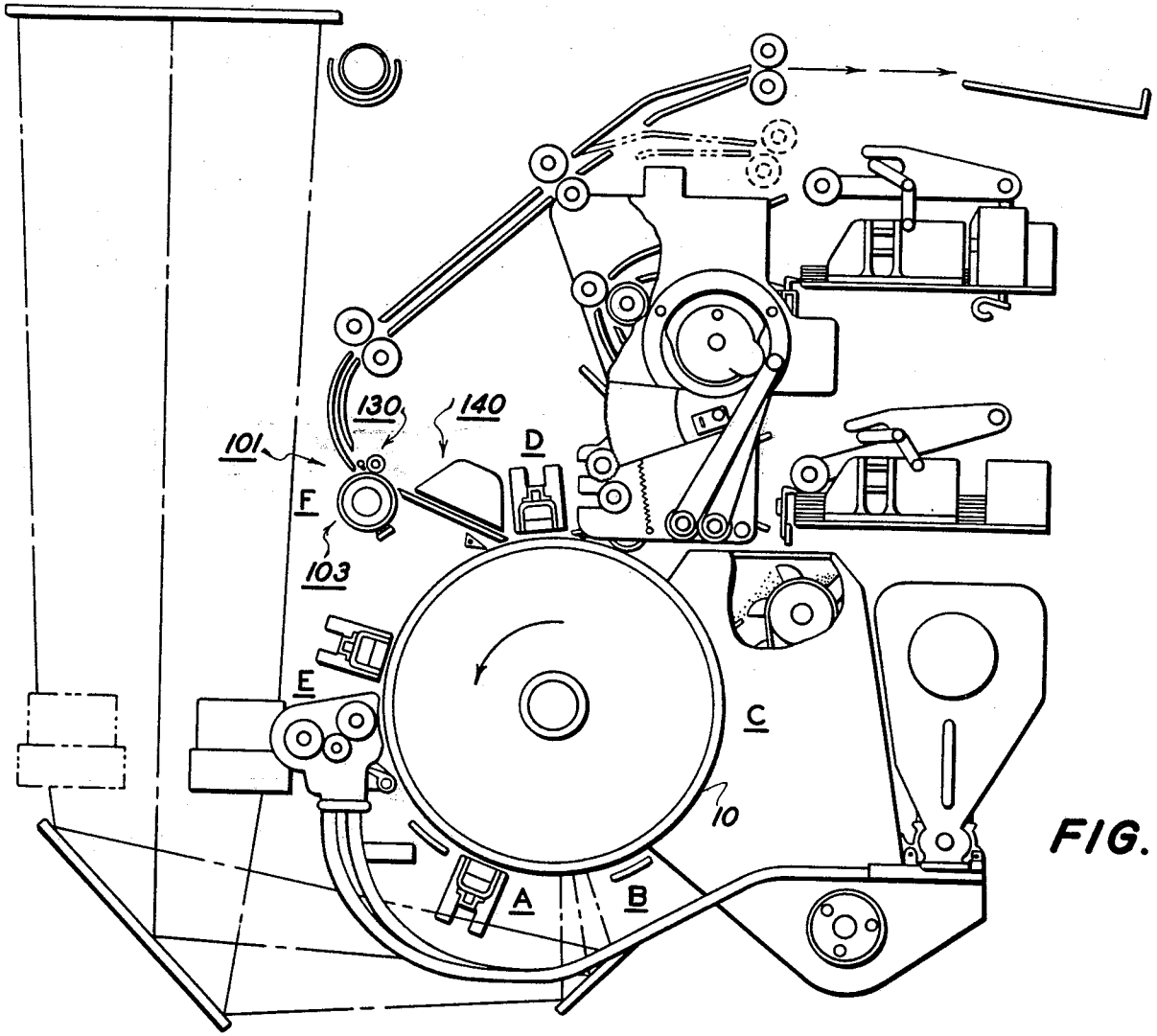
FIG. 1 illustrates schematically an electrostatic reproducing apparatus incorporating selective fusing apparatus constructed in accordance with the present invention.

Referring now to the drawings, there is shown in FIG. 1 an automatic xerographic reproducing machine incorporating an improved selective fusing apparatus according to the present invention. The automatic xerographic reproducing machine includes a xerographic plate or surface 10 formed in the shape of a drum. The plate has a photoconductive layer of light receiving surface on a conductive backing, journaled in a frame to rotate in the direction indicated by the arrow. The rotation will cause the plate surface to sequentially pass a series of xerographic processing stations. For the purpose of the present disclosure the several xerographic processing stations in the path of movement may be described functionally as follows:

A charging station A, at which a uniform electrostation charge is deposited in the photoconductive plate;

An exposure station B, at which light or a radiation pattern of copies to be reproduced is projected onto the plate surface to dissipate the charge in the exposed areas thereof to thereby form a latent electrostatic image of the copy to be reproduced;

A developing station C, at which xerographic developing material, including toner particles having an electrostatic charge opposite to that of the latent electrostation image, is cascaded over the latent electrostatic image to form a toner powder image in configuration of the copy being reproduced;

A transfer station D at which the toner powder image is electrostatically transferred from the plate surface to a support material such as paper;

A drum cleaning and discharge station E at which the plate surface is brushed to remove residual toner particles remainging thereon after image transfer and at which the plate is exposed to a relatively bright light source to effect substantially complete discharge of any residual electrostatic charge remaining thereon; and A fusing station F at which is positioned selective fusing apparatus 101 according to the invention for fusing powder images onto the support material as will be described more fully hereinafter.

The preceding description of the xerographic process stations is sufficient for an understanding of the instant invention. Further details may be had by reference to U.S. Pat. No. 3,578,859 filed July 3, 1969 and commonly assigned herewith.

Figure 2:
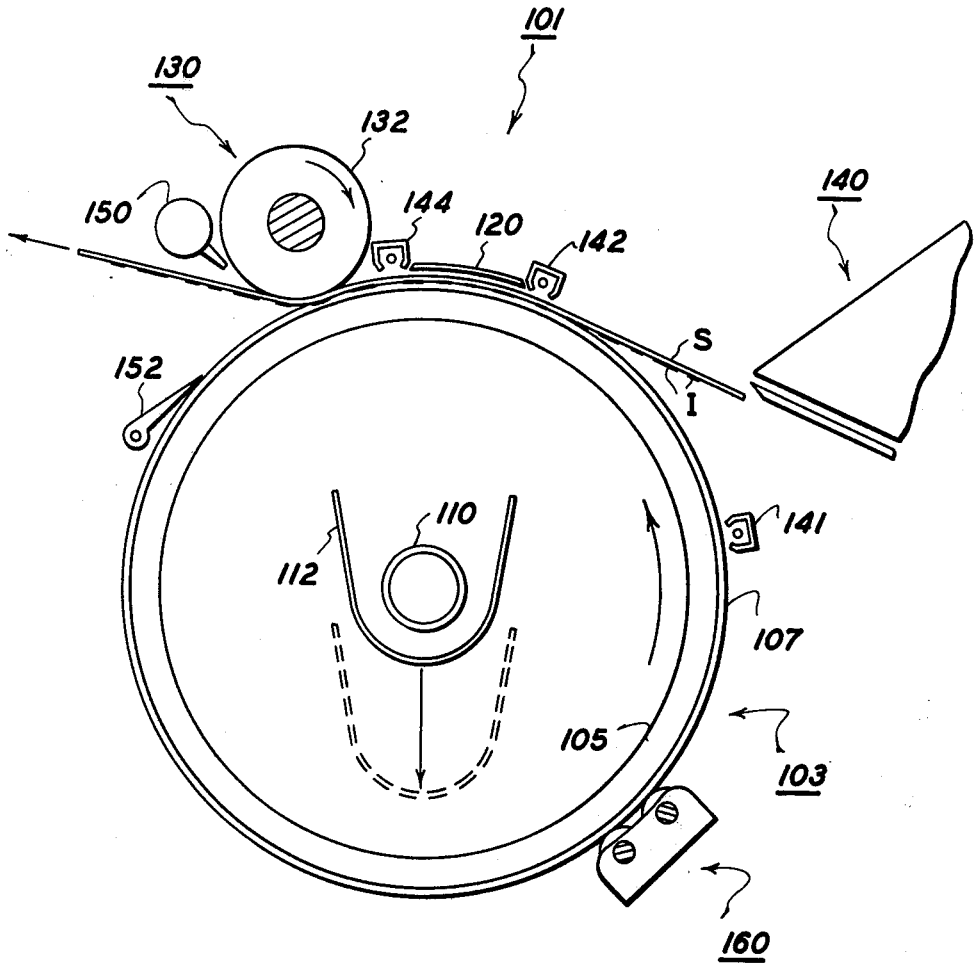
FIG. 2 is a side sectional view of the selective fusing apparatus of the invention.
Figure 3:
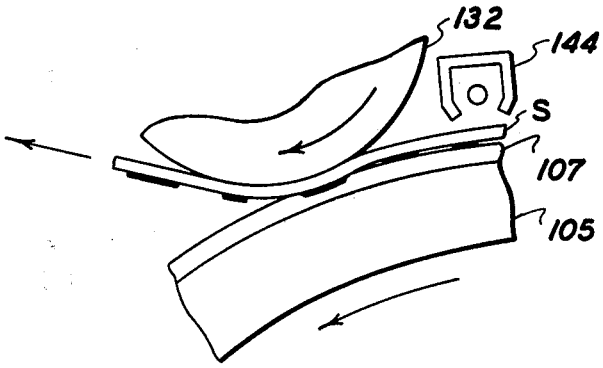
FIG. 3 is an enlarged portion of the nip of the selective fusing apparatus illustrating details thereof.

Referring now to FIGS. 2 and 3 the fusing apparatus 101 of the invention comprises a rotating fuser roll 103 which is made up of a core member 105 made out of quartz glass which is covered with an elastomeric layer 107 which is transparent to infrared radiation. Any suitable material can be used for layer 107. Typical materials are dimethyl RTV silicone rubber compounds, manufactured under the tradename GE602/615 by General Electric Company and potting encapsulating silicone resins manufactured under the tradename Sylgard 184 by Dow Corning Corporation. An infrared lamp 110 is positioned inside of the fuser roll with a retractable reflector member 112 positioned adjacent thereto for a purpose to be described hereinafter.

A stationary reflector member 120 extends in close proximity to the surface of layer 107 to shield the infrared radiation from lamp 110 from reaching the surrounding parts of the electrostatic reproducing machine and also to conserve energy by reflecting the energy onto the elastomeric layer 107 maintaining a warm temperature thereof. The reflector member 120 defines a portion of the fuser roll which serves as a heat transfer zone for transferring heat energy to the copy sheets bearing powder images made up of toner particles to be fused. Positioned slightly past the heat transfer zone is a relatively hard pressure roll 130 which is covered with a sleeve 132 made of any non-sticky smooth material such a fluoroethylene propylene or tetrafluoroethylene.

A copy sheet S bearing powder images I of toner to be fused is conveyed onto the fuser roll surface 103 by a conveyor 140. Sheet S is electrostatically tacked to the fuser roll surface which is charged by corotron 141. A tacking corotron 142 serves to electrostatically tack the sheet S onto the charged surface of the fuser roll. At this point fusing is accomplished similar to that of a radiant fusing system. In other words most of the radiant energy reaches the copy sheet portion which is white i.e. background gets reflected and the sheet remains relatively cool. The powder images however absorb the energy from lamp 110 thereby causing the images to melt and become firmly fixed onto the copy sheet S. The background image particles, however, remain unfused on the copy sheet as they do not receive sufficient heat from the lamp 110 to overcome the heat sinking effect on the paper sheet. At this instant conduction from the fuser roll surface plays a significant purpose. The background toner particles on the sheet S which are in contact with the warm elastomeric layer 107 soften and adhere to it. The interface between the powder images and the copy sheet remains low in the background toner particle areas and will not therefore allow the particles to adhere to its surface.

The copy sheet advances through the heat transfer zone and through a detack area at which a detack corotron 144 imparts an electrostatic charge which serves to separate the sheet from the surface of the fuser roll. A blower 150 is positioned adjacent to the exit of the sheet S from the nip to provide cooling and to further insure that the copy sheets separate easily from the fuser roll surface. All of the background toner particles are transferred to the fuser roll surface by maintaining a relatively high particle viscosity and a relatively cool sheet S. A set of stripper fingers 152 are positioned past the cooling zone to guide the copy sheet and prevent the sheet from wrapping around the fuser roll surface. Cleaning rollers generally designated 160 are positioned in the path of the fuser roll to collect powder image particles and/or contaminants in a manner described in copending application Ser. No. 309,543, filed Nov. 24, 1972 and commonly assigned herewith.

In operation during standby retractable reflector member 112 is in a retracted position away from lamp 110 and a low power level is applied to the lamp. The power is sufficient to maintain the fuser roll surface at a temperature ranging from about 200° to about 220°F. During the print mode of operation full power is applied to the lamp. At the same time the retractable reflector member 112 is moved into a focusing position to concentrate all the energy toward the sheet S bearing the image toner particles which are to be fused to the sheet S. Charge and tacking corotrons 141 and 142, respectively, are activated to generate charge onto the surface of the fuser roll and electrostatically tack the sheet S thereto at the beginning of the heat transfer zone. In the heat transfer zone the powder images receive direction radiation from the lamp through core member 105 and elastomer layer 107. Practical heat transfer is obtained by heat conduction to enahnce the low density image fusing capability by raising the sheet powder image interface temperature. The background image particles, on the other hand, receive less heat from the radiant heat and conduction and remain molten on the top side of the particles which are in contact with elastomeric layer 107. At this time particle adhesion to the fuser roll surface is greater than the sheet particle interface in the background areas whereas in the image areas the image particles adhere to the fuser roll surface or layer 107 less than they do to the sheet surface. Subsequent to the heat transfer zone sheet S passes through a pressure zone after advancing past detack corotron 144 where the sheet charge is neutralized to facilitate stripping from the surface of the fuser roll. The pressure zone temperature at the nip of fuser roll and pressure roll 130 are critical since a relatively high pressure would tend to fix the background image particles as well as the main image particles onto the sheet. Therefore the pressure and exit temperatures are optimized based on such factors as the thickness of the elastomer layer 107, the properties of the elastomer, the heat transfer zone, the surface speed and the type of toner particles used. This criticality is controlled by blower 150 which maintains a temperature sufficient for accomplishing the purpose intended. The copy sheet is transported from the nip of the rolls along its intended path. Powder image particles from the background which have been offset onto the fuser roll surface and any contaminants are collected on the fuser roll surface and are cleaned by cleaning rolls 160.

It will be appreciated that the selective fusing apparatus of the invention is extremely useful in the fusing of powder images onto copy sheets made of paper. It will be further appreciated that the fusing apparatus is relatively safe and that it prevents any chance of fire during a paper jam in the machine. Furthermore the copy sheet is selectively fused to produce a high quality copy without objectionable background. In addition cleaning is accomplished on a continuous bases so that background materials are not offset onto expensive copy sheets which can degrade the quality of the copies being reproduced.

While there have been shown and described and pointed out the fundamental novel features of the invention as applied to a preferred embodiment, it will be understood that various omissions and substitutions and changes in the form and details of the device illustrated and in its operation may be made by those skilled in the art without departing from the spirit of the invention.

What is claimed is:

1. In an electrostatic reproduction machine in which a dry fusing device for fusing powder images onto copy sheets made of paper is accomplished by passing the sheet bearing the powder images through a nip defined by rotatable members which apply heat and pressure thereto an improved selective dry fusing apparatus comprising:

a rigid core member made of material which is transparent to radiant energy, a source of radiation disposed in the interior of said core member transmitting radiant energy, a layer of elastomeric material which is transparent to radiant energy covering the surface of said rigid core member, reflector means positioned along the periphery of the elastomeric layer closely spaced thereto defining a heat transfer zone at which radiation is reflected onto the surface of the layer, tacking and detacking means positioned adjacent to the heat transfer zone to tack sheets with powder images contacting the surface of said elastomeric layer and detack sheets therefrom at the exit in the heat transfer zone, and pressure roll means positioned at the exit of the heat transfer zone in pressure contact with said elastomeric layer to provide controlled heat and pressure to the copy sheet exiting from the heat transfer zone, whereby selective fusing of the powder images onto the copy sheet is effected to produce high quality copies.

2. Apparatus according to claim 1 including cooling means positioned at the exit of the nip defined by the pressure roll and elastomeric layer.

3. Apparatus according to claim 1 including a retractable reflector device positioned around the source of radiation which is moveable from a first position away from the source of radiation when in a non-fusing condition to a second position in close proximity to the source of radiation when in a fusing condition.

4. Apparatus according to claim 1 including cleaning rolls positioned in the path of elastomeric layer surface for removing powder image residual particles and other contaminants therefrom.

* * * * *